US005937867A

United States Patent [19]

Williams

[11] Patent Number: 5,937,867

[45] Date of Patent: Aug. 17, 1999

[54] HAIRPIECE AND METHOD OF USING SAME

[76] Inventor: Ella J. Williams, 2408 Jefferson St., Gary, Ind. 46407

[21] Appl. No.: 09/206,314

[22] Filed: Dec. 7, 1998

Related U.S. Application Data

[63] Continuation-in-part of application No. 09/056,324, Apr. 7, 1998, abandoned.

[51] Int. Cl.[6] ..... A41G 5/00

[52] U.S. Cl. ..... 132/201; 132/53; 132/275; 132/133

[58] Field of Search ..... 132/53, 54, 55, 132/277, 279, 133, 275, 201

[56] References Cited

U.S. PATENT DOCUMENTS

| | | | |
|---|---|---|---|
| D. 278,940 | 5/1985 | Incando | D28/93 |
| 541,125 | 1/1895 | Simonson . | |
| 1,741,073 | 12/1929 | Porter . | |
| 2,445,071 | 7/1948 | Kovacs et al. | 132/22 |
| 2,651,310 | 9/1953 | Selson | 132/48 |
| 3,126,018 | 3/1964 | Sidelman | 132/54 |
| 4,254,783 | 3/1981 | Kim | 132/11 R |
| 5,154,195 | 10/1992 | Irisawa | 132/201 |
| 5,501,239 | 3/1996 | Walker | 132/275 |
| 5,520,201 | 5/1996 | Hart et al. | 132/277 |
| 5,657,774 | 8/1997 | Niese | 132/54 |
| 5,706,837 | 1/1998 | Iwata | 132/200 |
| 5,722,434 | 3/1998 | Walker | 132/54 |

FOREIGN PATENT DOCUMENTS

| | | |
|---|---|---|
| 556592 | 4/1957 | Belgium . |
| 532869 | 11/1956 | Canada . |
| 607106 | 10/1960 | Canada . |
| 6823 | 7/1904 | Denmark . |
| 20460 | 10/1987 | France . |

*Primary Examiner*—Todd E. Manahan
*Attorney, Agent, or Firm*—Fitch, Even, Tabin & Flannery

[57] ABSTRACT

A hairpiece is provided for extending the length of a wearer's natural hair. The hairpiece includes an attachment and a detachable flexible band, such as a fabric band. The attachment has a pair of free ends and male and female snap fastener components respectively located near either free end. Attached to the flexible band are a plurality of hair strands and a pair of complementary snap fastener components mated to the snap fastener components of the attachment. This arrangement allows the hair strands to be selectively coupled to the attachment. The attachment can also include a plurality of inwardly projecting comb-like tangs. The comb-like tangs prevent the hairpiece from being easily displaced after being positioned on the wearer's head. A method of attaching the hairpiece to existing hair is also provided.

8 Claims, 2 Drawing Sheets

HAIRPIECE AND METHOD OF USING SAME

CROSS-REFERENCE TO RELATED APPLICATION

This is a continuation-in-part of prior application Ser. No. 09/056,324, filed Apr. 7, 1998 now abandoned which is hereby incorporated herein by reference in its entirety.

FIELD OF THE INVENTION

This invention relates to hairpieces, and in particular, to a hairpiece for adding length to a wearer's naturally existing hair.

BACKGROUND OF THE INVENTION

Concern over personal appearance is a virtually universal trait among humans, transcending almost all cultures and societies throughout history. An especially important aspect of this concern is the style and appearance of one's hair.

Hairpieces have become extremely popular as a means for changing the style and appearance of a person's natural hair. Unfortunately, a truly effective technique for attaching hairpieces has not been found in spite of great efforts to reach this end. Such efforts have resulted in some exotic techniques, including hair transplants and surgically implanted hairpiece anchors, but these costly and inconvenient solutions are not the answer for many individuals.

Other, less exotic techniques of attaching hairpieces include hair weaves and the use of adhesives. Hair weaves involve intertwining artificial hair with naturally occurring hair. However, weaves are troublesome because wearers cannot easily and quickly attach or remove the hairpiece. Adhesives, on the other hand, prevent dermal respiration of the scalp and can lead to hair loss.

A common type of hairpiece the fabric band hairpieces, which is composed of hair strands sewn to a single fabric band. This type of hairpiece is attached by snugly wrapping the band around the wearer's head or a clump of the wearer's existing hair. After wrapping the band into place, the ends of the band are fastened together by either tying or snapping them together. Pins and separate combs can be used to further secure the hairpiece to the wearer's head. In spite of this, the fabric-band hairpiece can be easily displaced from its position.

Another drawback of many conventional hairpieces is that they permit only one appearance. Consequently, a wearer must purchase more than one hairpiece to achieve different hair styles.

The drawbacks and limitations of conventional hairpieces demonstrate the market need for a versatile hairpiece that not only permits different hair styles, but also permits convenient and secure attachment to a wearer's head, without the use of pins, glue, or surgery.

SUMMARY OF THE INVENTION

It is an advantage of the present invention to provide a unique hairpiece and method of attachment that overcomes the above-identified limitations of conventional hairpieces.

The hairpiece of the present invention provides a superior means for extending the apparent length of the wearer's hair. It is particularly useful for creating styles that require long hair, such as ponytails or boufants. One advantage of the hairpiece is that does not require the use of adhesives, pins, or surgery, and is therefore more convenient to attach to the wearer's head. Another advantage is that it provides a vastly improved means for securely attaching to the wearer's existing hair. A further advantage of the hairpiece is that it permits the wearer to create a number of different styles.

In accordance with an embodiment of the present invention, a hairpiece includes an attachment for detachably clasping the natural hair of a wearer and a hair band, such as a fabric band having hair strands sewn to it, that can detachably fasten to the attachment. The detachable hair band can be a commercially-available fabric-band hair piece specially adapted to couple to the attachment. By modifying commercially-available fabric-band hairpieces in accordance with an embodiment of the invention, a variety of interchangeable hair bands can be easily manufactured and made readily available, providing a plurality of interchangeable hair bands so that wearers can easily create different hair styles.

The attachment includes a pair of free ends, a male snap fastener component located near one free end, and a female snap fastener component located near the other free end. The hair band includes a pair of complementary snap fastener components mated to those located on the attachment. Providing complementary pairs of fastener components, i.e., pairs consisting of male and female components, on both attachment and hair band maintains a given orientation therebetween. In addition, the attachment can include comb-like teeth for improving the hairpiece's ability to grip a wearer's natural hair.

According to one embodiment of the invention, the attachment can include comb-like teeth for improving the hairpiece's ability to grip a wearer's natural hair.

BRIEF DESCRIPTION OF THE DRAWINGS

The invention is pointed out with particularity in the appended claims. However, other features of the invention will become more apparent, and the invention will be best understood by referring to the following detailed description in conjunction with the accompanying drawings, in which:

DETAILED DESCRIPTION OF THE PREFERRED EMBODIMENT

Figure 1:
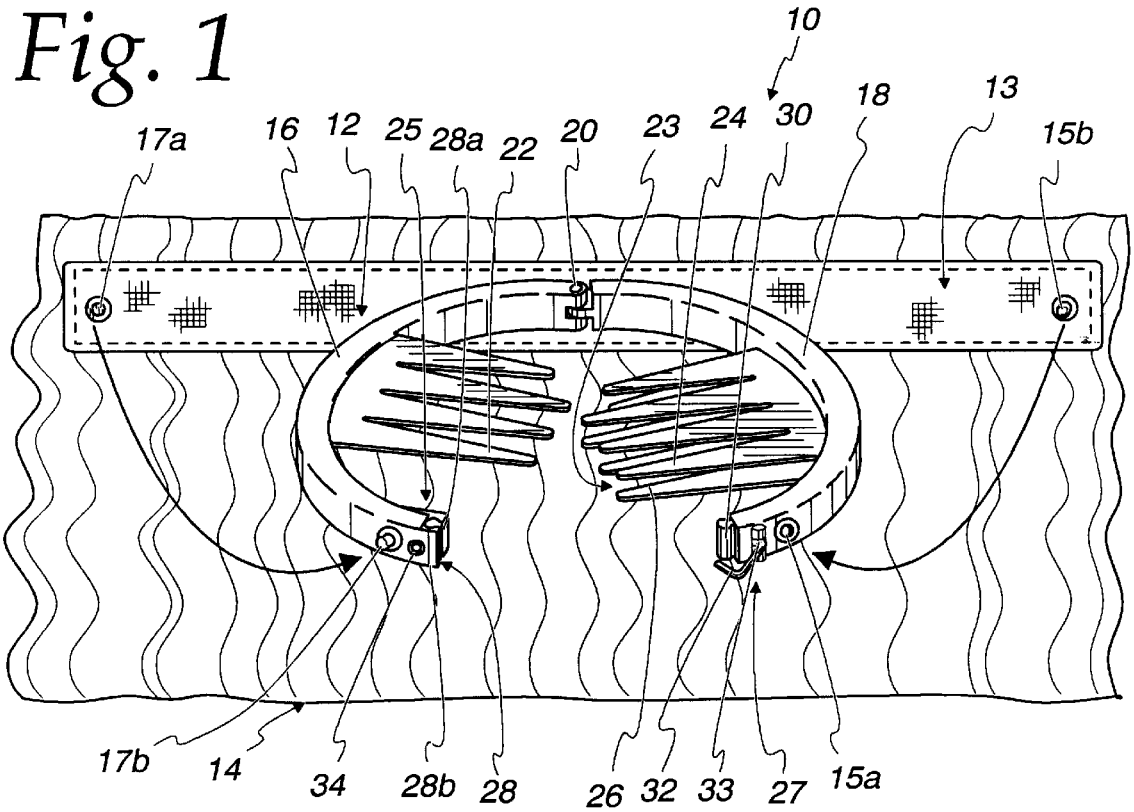
FIG. 1 is a perspective view of a hairpiece in accordance with one embodiment of the present invention.

Referring now to the drawings, and more particularly to FIG. 1, there is illustrated a hairpiece 10 comprising a hinged attachment 12, a flexible band 13, such as a fabric band, and a plurality of hair strands 14 attached to the flexible band 13. A pair of snap fasteners 15*a–b*, 17*a–b* permits the flexible band 13 to be selectively attached to the hinged attachment band 12. The band 13 and attachment 12 each include components of the snap fasteners 15*a–b*, 19*a–b*. Specifically, the attachment 12 includes a male snap fastener component 19*b*, which corresponds to a female snap fastener component 19*a* on the band 13. The attachment 12 also includes a female snap fastener component 15*a*, which corresponds to a male snap fastener component 15*b* on the band 13. This arrangement ensures that the band 13 and attachment 12 will always be properly oriented relative to each other when coupled together.

Figure 2:
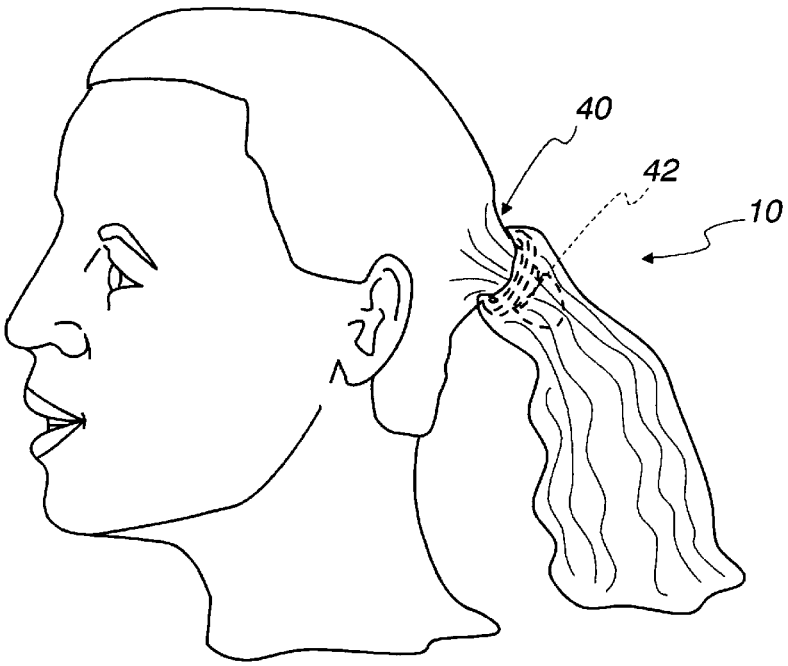
FIG. 2 shows an example of how the hairpiece of FIGS. 1, and 4 can be attached to a wearer's existing hair.
Figure 3:
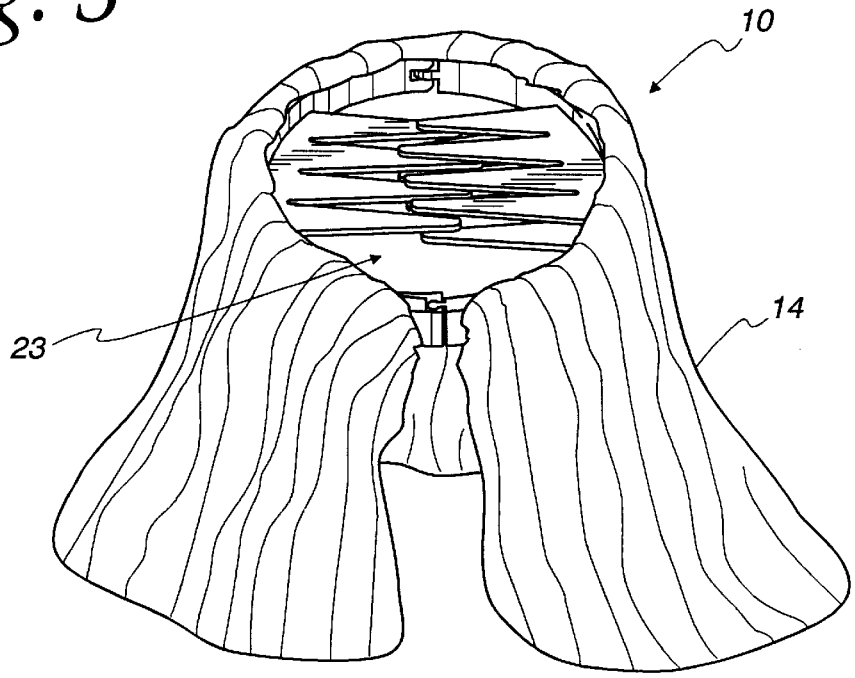
FIG. 3 is a perspective view showing the hairpiece of FIG. 1 in a closed position.
Figure 4:
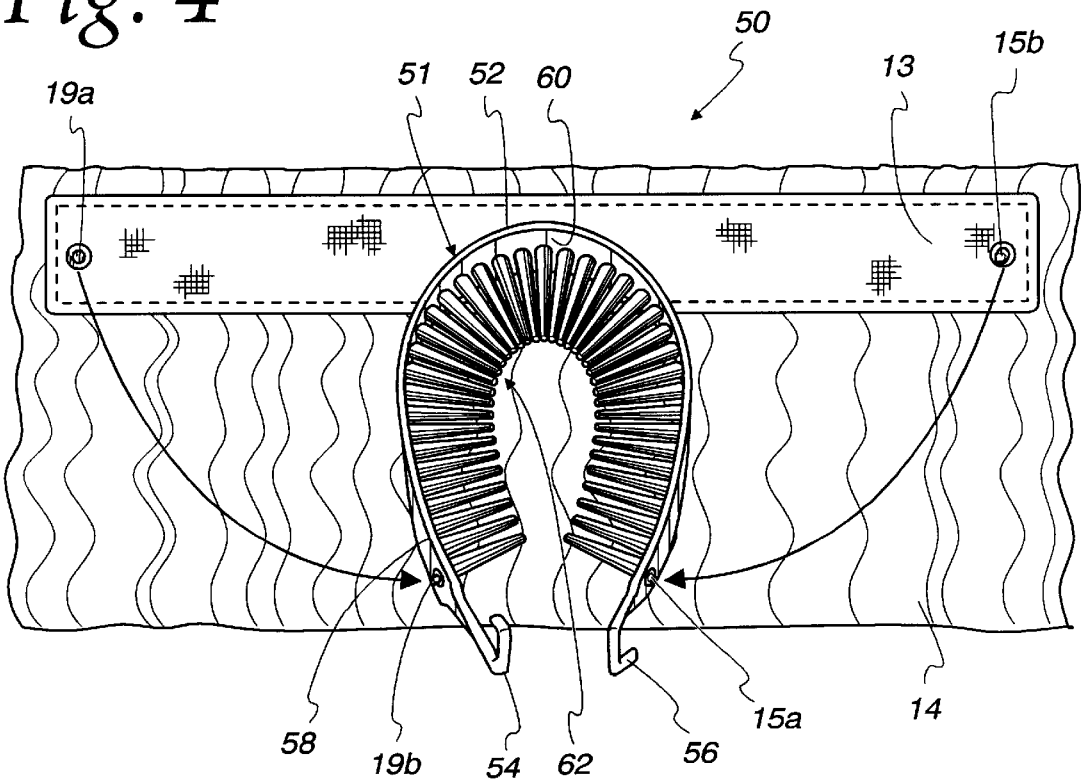
FIG. 4 is a perspective view of a hairpiece in accordance with another embodiment of the present invention.

FIG. 2 illustrates how the hairpieces of FIGS. 1 and 4 can attach to a wearer's naturally existing hair. The hairpieces 10, 50 disclosed herein are especially effective when attached to naturally thick or coarse hair, such as that which is typical among people of African or Asian descent. To attach the hairpiece 10 to a wearer's hair, the members 16–18 are moved to an open position, as shown in FIG. 1. The wearer's natural hair 40 is then inserted between the members 16–18 and the members are moved into a closed position, thereby clasping the wearer's hair 40 between the two members 16–18. FIG. 3 shows an example of the hairpiece 10 in a closed position, unattached to the wearer's hair.

A retaining band 42, such as a hair tie or rubber band, can be placed around the wearer's hair 40 to provide a more secure attachment of the hairpiece. To accomplish this, the retaining band 42 is first wrapped tightly around the existing hair 40. Then, the wearer's hair 40 is inserted between the members 16–18, while in the open position, so that the attachment 12 is located above the band 42. The members are then closed, securing the hairpiece onto the natural hair 40 at a location between the retaining band 42 and the wearer's scalp. Placing the attachment 12 or 51 closer to the base of the wearer's natural hair 40 produces a more secure attachment. The band 42 helps to maintain this secure attachment by keeping the hairpiece 10 from moving out of place.

Referring back to FIG. 1, the strands of hair 14 can be wefted or unwefted synthetic or human hair. The strands 14 can be attached to the band 13 by tying or sewing the hair 14 to the band 13. In addition, an adhesive can be used to fasten the hair 14 to the band 13.

Although the above discussion refers to attaching only the ends of the hair strands 14 to the hinged attachment 12, the strands 14 can be attached any point along their length. Attaching the hair at different points produces different hairpieces, each being useful for creating a variety of different hairstyles.

The hinged attachment 12 includes a semi-circular first member 16, a semi-circular second member 18, and a hinge 20 connecting together the ends of the members 16–18. Complementary snap fastener components 15*a*, 19*b* can be located near the free ends 25, 27 of the members 16–18. Although not shown, additional snap fasteners can be included along the band 13 and the outside of the members 16–18 to improve the security of the attachment of the band 13 to the members 16–18. Alternatively, double-sided tape can be applied between the outside surface of the members 16–18 and the engaging surface of the band 13 to improve the attachment.

The members 16–18 can be made of a thermoplastic material. Each member 16–18 has a plurality of comb-like tangs 22 projecting inward toward the opposing member. The tangs 22 have tampered or rounded free ends permitting a wearer's natural hair to be guided into the spaces between the tangs 22. As the members 16–18 are moved to the closed position, the comb-like tangs 22 pass through the wearer's hair to provide a superior grip.

The comb-like tangs 22 of the second member 18 include two rows of tangs 23 that are vertically stacked in a substantially parallel arrangement. When the first and second members 16–18 are moved toward one another, the comb-like tangs 22 of the first member 16 slide between corresponding vertically-aligned tangs in the upper row 24 and the lower row 26. Positioning the tangs 22 along the first and second members 16–18 in this manner reduces any lateral flexing of the tangs 22 when the members 16–18 are in the closed position. In turn, this helps prevent the hairpiece 10 from moving out of position after it is attached to the wearer's hair.

The hairpiece 10 also includes a means for selectively coupling together the unhinged ends of the members 16–18 when they are moved into the closed position. Any suitable means can be used for this purpose, such as a latch, lock, or detent mechanism. In the example shown, the hairpiece 10 includes a detent mechanism having a female portion 28 and a male portion 30 integrally formed at the unhinged ends of the members 16–18. The female portion 28 includes resilient lip projections 28*a–b* which define a slot having a restricted opening. As the members 16–18 are moved into the closed position, the male portion 30 engages and cams against the lips 28*a–b* to force them apart. With the lips 28*a–b* separated, the male portion 30 can be pushed through the opening, whereupon the lips 28*a–b* rebound to their original configuration to securely capture the male portion 30 in the slot, thereby providing a snap-fit connection between the male and female portions 28–30.

A secondary safety latch can also be included at the unhinged ends. The safety latch include a hook 32 and a hook receiving means 34, which can include an eyelet or pin projecting from the member 16. The hook 32 is swingable about its end 33 so that in the closed position, the hook 33 can be moved to engage the receiving means 34.

The hinge 20 can be any means for hingedly connecting the first and second members 16–18. For instance, the hinge 20 can be a weaken portion of plastic integrally formed at and connecting the ends of the members 16–18. In this case, the members 16–18 could be injection molded as a single piece.

FIG. 3 shows a hairpiece 50 in accordance with a second embodiment of the present invention. The hairpiece 50 includes an attachment 51, the band 13, and a plurality of hair strands 14 fastened to the band 13. The hairpiece 50 functions in a manner similar to that of the hairpiece shown in FIG. 1 in that it permits the band 13 to be selectively attached to the attachment 51.

The attachment 51 includes a flexible member 52 having a plurality of teeth 62 projecting from its inner side 60. The flexible member 52 and teeth 62 can be integrally formed using injection-molded plastic.

Located near the free ends of the flexible member 52 on its outer side 58 are complementary snap fastener components 15*a*, 19*b*. Near one free end, there is a male fastener component 19*b*, while at the other free end there is a female fastener component 15*a*. The snap fastener components 15*a*, 19*b* of the flexible member 52 are mated to corresponding fastener components 19*a*, 15*b* located on the band 13. Additional snap fasteners (not shown), can be included on the band 13 and attachment 12.

The band 13 can be detachably fastened to the flexible member 52 in the same manner as discussed earlier for the hairpiece 10 shown in FIG. 1.

A pair of opposingly oriented hooks 54–56 can be formed at the free ends of the member 52, permitting the free ends to be detachably coupled together so that the member 52 is placed in a closed position.

To attach the second hairpiece 50 to the wearer's hair 40, the free ends of the flexible members 52 are uncoupled permitting the attachment 51 to assume an open position. The flexible member 52 is then wrapped around the stub of existing hair 40 such that the teeth 62 engage the hair 40 above the band 42. The hooks 54–56 are then coupled to one another to secure the hairpiece 50 to the existing hair 40.

While specific embodiments of the present invention have been shown and described, it will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A hairpiece for detachably fastening to existing hair, comprising:

a first member and a second member hingedly connected and moveable toward and away from each other for selectively engaging therebetween the existing hair;

a male snap fastener component located on the first member;

a female snap fastener component located on the second member;

a flexible band having a pair of complementary snap fastener components adapted to detachably couple to the male and female snap fastener components located on the members; and a plurality of hair strands attached to the flexible band.

2. The hairpiece of claim 1, wherein the hairpiece includes a hinge integrally formed at ends of the first and second members.

3. The hairpiece of claim 1, further comprising:

a weakened portion of plastic for hingedly connecting the first and second members.

4. The hairpiece of claim 1, wherein at least one of the members has a plurality of comb-like tangs projecting toward the other member.

5. A hairpiece for detachably fastening to existing hair, comprising:

a flexible member having an inner side, an outer side, and a pair of free ends;

a male snap fastener component located on the outer side of the flexible member near one of the free ends;

a female snap fastener component located on the outer side of the flexible member near the other free end;

a flexible band having a pair of complementary snap fastener components adapted to detachably couple to the male and female snap fastener components located on the flexible member; and a plurality of hair strands attached to the flexible band.

6. The hairpiece of claim 5, further comprising:

means for coupling together the free ends of the flexible member.

7. The hairpiece of claim 5, further comprising a plurality of comb-like tangs projecting from the inner side of the flexible member.

8. A method of attaching a hairpiece to existing hair, comprising:

providing a hair attachment having a pair of free ends, a male snap fastener component located near one of the free ends and a female snap fastener located near the other free end;

providing a flexible band having a plurality of hair strands attached thereto and a pair of complementary snap fastener components adapted to detachably couple to the male and female snap fastener components of the attachment;

coupling the flexible band to the attachment to form the hairpiece;

engaging the attachment to the existing hair; and coupling together the free ends of the attachment to securely attach the hairpiece to the existing hair.

* * * * *